US008526655B2

(12) United States Patent
Dibb et al.

(10) Patent No.: US 8,526,655 B2
(45) Date of Patent: Sep. 3, 2013

(54) LOUDSPEAKER ENCLOSURES FOR MOUNTING IN AN APERTURE IN A CAVITY WALL

(75) Inventors: John Joseph Dibb, Steyning (GB); Stuart Michael Nevill, Brighton (GB); Richard Hartshorn, London (GB); Edward Goodwin, London (GB); Douglas James Standen, Shoreham By Sea W Sussex (GB)

(73) Assignee: B & W Group Ltd, West Sussex (GB)

( * ) Notice: Subject to any disclaimer, the term of this patent is extended or adjusted under 35 U.S.C. 154(b) by 472 days.

(21) Appl. No.: 12/872,548

(22) Filed: Aug. 31, 2010

(65) Prior Publication Data

US 2011/0051968 A1 Mar. 3, 2011

(30) Foreign Application Priority Data

Sep. 3, 2009 (GB) ..... 0915392.5

(51) Int. Cl.
*H04R 1/20* (2006.01)
*H04R 1/02* (2006.01)

(52) U.S. Cl.
USPC ..... 381/345; 381/351; 381/386

(58) Field of Classification Search
USPC ..... 381/87, 332, 333, 334, 335, 150, 381/152, 345, 349, 351, 386, 302, 86, 389; 181/148, 150, 198, 199
See application file for complete search history.

(56) References Cited

U.S. PATENT DOCUMENTS

| | | | | |
|---|---|---|---|---|
| 4,439,643 | A | 3/1984 | Schweizer | |
| 5,574,796 | A | 11/1996 | Keezer | |
| 5,734,732 | A | 3/1998 | Lemmon | |
| 5,828,765 | A | 10/1998 | Gable | |
| 5,847,331 | A | 12/1998 | Vollmer et al. | |
| 5,937,073 | A | 8/1999 | Van Gieson | |
| 6,101,262 | A | 8/2000 | Haase et al. | |
| 6,243,478 | B1 | 6/2001 | Tsao | |
| 6,320,971 | B1 | 11/2001 | Tozawa | |
| 6,343,135 | B1 | 1/2002 | Ellero et al. | |
| 6,415,036 | B1 | 7/2002 | Ritter et al. | |
| 6,741,720 | B1 * | 5/2004 | Myatt | 381/386 |
| 7,036,781 | B1 * | 5/2006 | Bothe | 248/291.1 |
| 2007/0131477 | A1 | 6/2007 | Combest et al. | |

* cited by examiner

*Primary Examiner* — Curtis Kuntz
*Assistant Examiner* — David J Ho
(74) *Attorney, Agent, or Firm* — Buchanan Ingersoll & Rooney PC

(57) ABSTRACT

A loudspeaker enclosure for mounting in an aperture in a cavity wall with a part of the enclosure being located within the wall cavity adjacent the aperture, comprises a main enclosure unit for mounting in the aperture and housing one or more loudspeaker drive units, and a supplementary enclosure unit for location within the wall cavity and being acoustically connected in use to the main unit to increase the effective internal volume of the enclosure beyond that of the main unit. The supplementary unit is connected to the main unit by an articulated connection enabling the main unit to be angled relative to the supplementary unit while the supplementary unit is being inserted through the aperture and into the wall cavity, and enabling the main unit to be aligned with and acoustically coupled to the supplementary unit when the main unit is positioned in the wall aperture.

20 Claims, 5 Drawing Sheets

LOUDSPEAKER ENCLOSURES FOR MOUNTING IN AN APERTURE IN A CAVITY WALL

This invention related to loudspeaker enclosures for mounting in an aperture in a cavity wall.

In order to obtain good bass response, the effective internal volume of a loudspeaker enclosure should be adequately large. For aesthetic reasons, it is desirable, when a cavity wall-mounted loudspeaker enclosure is large, to conceal part of the enclosure within the wall cavity. That, however, represents an installation difficulty because there is only limited space within the wall cavity and it is undesirable to make an over-size hole in the wall for the sake of being able to install the enclosure.

U.S. Pat. No. 6,741,720 discloses an enclosure having a tapered shape for a lower part of the enclosure so that the enclosure can be angularly inserted into the wall with the tapered part passing through the aperture and into the wall cavity. The provision of an adequately large taper to allow entry into the wall cavity of the tapered portion without the rest of the enclosure fouling the edges of the aperture means, however, that the enclosure in many cases cannot be as large as would be acoustically desirable, given that cavity walls impose limitations because of the spacing of studs and the depth of the cavity.

It is an object of the invention to provide a loudspeaker enclosure for mounting in an aperture in a cavity wall with a part of the enclosure being located within the wall cavity adjacent the aperture, which is able to combine ease of installation with a large internal volume for good acoustic performance.

The present invention provides a loudspeaker enclosure for mounting in an aperture in a cavity wall with a part of the enclosure being located within the wall cavity adjacent the aperture, wherein the enclosure comprises:

- a main enclosure unit for mounting in the aperture and housing one or more loudspeaker drive units, and
- a supplementary enclosure unit for location within the wall cavity and being acoustically connected in use to the main unit to increase the effective internal volume of the enclosure beyond that of the main unit, and wherein:
- the supplementary unit is connected to the main unit by an articulated connection enabling the main unit to be angled relative to the supplementary unit while the supplementary unit is being inserted through the aperture and into the wall cavity, and enabling the main unit to be aligned with and acoustically coupled to the supplementary unit when the main unit is positioned in the wall aperture. Because the enclosure is formed by two units and the main unit can be angled relative to the supplementary unit, a larger supplementary unit can be got into the wall cavity than would be possible if the enclosure were a single rigid whole. The use of a larger supplementary unit enables the acoustic properties of the enclosure to be improved.

Advantageously, securing means are provided to fix the supplementary unit in position relative to the main unit when the two units are installed and aligned. The securing means ensures the integrity of the mechanical and acoustic connection between the two units, stops one unit from rattling against the other, and prevents the installed enclosure from coming out of the installed location.

Preferably, the securing means comprises screw-threaded securing means. Such a fastening is simple to use and very secure.

Advantageously, the securing means comprises two or more threaded studs projecting from the supplementary unit, and associated nuts to secure the ends of the studs within the main unit. Such a fastening is simple for the installer.

Preferably, the associated nuts are wing nuts. Wings nuts have the advantage of easy tightening without a special tool.

Advantageously, the articulated connection comprises a hinge. A hinge is a particularly simple form of articulate connection although some type of concertina-like connection could be used instead.

The hinge may comprise a living hinge comprising a first hinge wing attached, in use, to the main unit, a second hinge wing attached, in use, to the supplementary unit, and a web of material connecting the first and second hinge wings. Such a hinge is simple and cheap and to use. Alternatively, an ordinary hinge with a hinge pin may be used.

Advantageously, the supplementary unit is shallower than the main unit, and the articulated connection is located at the front of the supplementary unit but is spaced from the front of the main unit by a spacing such as to cause the backs of the units to be in alignment in use, the terms “front” and “back” referring to the installed orientation of the units. By this means, the enclosure can be used with various thicknesses of wall in front of the wall cavity.

Preferably, the supplementary unit has a depth substantially half that of the main unit. Such a dimension is suitable for most cavity wall constructions likely to be encountered in practice.

Advantageously, the back, in the in use orientation, of the supplementary unit has a bevel running from the end of the supplementary unit remote from the main unit for part only of the length of the supplementary unit. The bevel further facilitates the installation of the enclosure in the cavity wall.

Preferably, the bevel runs between one quarter and two thirds the lengths of the supplementary unit. These lengths of bevel are advantageous in facilitating installation without substantially impairing acoustic properties.

Preferably, an acoustic sealing gasket is provided between the adjacent ends of the main and supplementary units. The use of a gasket ensures a good acoustic seal between the two units. If desired, a resilient gasket may be used.

Preferably, respective oblong boxes arranged lengthwise in use with respect to each other constitute the main and supplementary units. This is an advantageous geometric arrangement both as regards insertion in a cavity wall and acoustically.

Preferably, an aperture for acoustic communication with the other unit is provided at one longitudinal end of the supplementary unit and at each longitudinal end of the main unit, and a blanking plate is provided for closing a selected one of the apertures of the main unit. By this means, the user is able to choose at which end to attach the supplementary unit according to available space in the cavity wall.

Preferably, the main unit comprises a crate-like body portion of moulded plastics material, and a baffle plate mounting the one or more loudspeaker drive units and being releasably mounted on the mouth of the crate-like body portion. This construction allows easy access into the interior of the main unit for making mechanical connections.

Push and turn quick-release fastenings may be provided to secure the baffle plate to the crate-like body portion. Such fastenings are particularly simple for the installer to use.

Advantageously, the supplementary enclosure unit can be sub-divided into a plurality of sub-parts, an articulated connection being provided between adjacent sub-parts, and the articulated connection of the sub-parts enabling the sub-parts to be angled relative to each other while the supplementary unit is being inserted through the aperture and into the wall cavity, and enabling the sub-parts to be aligned with and acoustically coupled to each other when the supplementary unit is positioned in the wall cavity. Such an arrangement further facilitates the installation of the enclosure in a cavity wall and permits the use of a supplementary unit of greater length.

The supplementary enclosure unit may be sub-divided into just two sub-parts.

The invention also provides a supplementary unit and articulated connection having the features defined in any preceding claim for retro-fitting to an existing main unit. The purchase of a supplementary unit on its own enables a user to upgrade the acoustic properties of an existing enclosure installed in a cavity wall.

A loudspeaker enclosure for mounting in an aperture in a cavity wall will now be described by way of example only with reference to the accompanying drawings in which.

Figure 1:
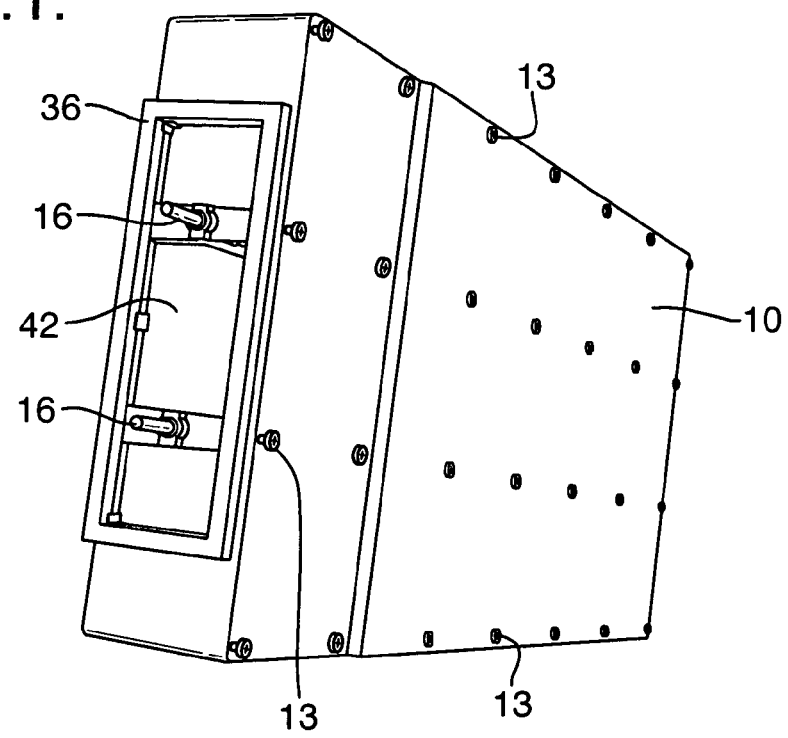
FIG. 1 is a perspective view of a supplementary unit of the enclosure.
Figure 2:
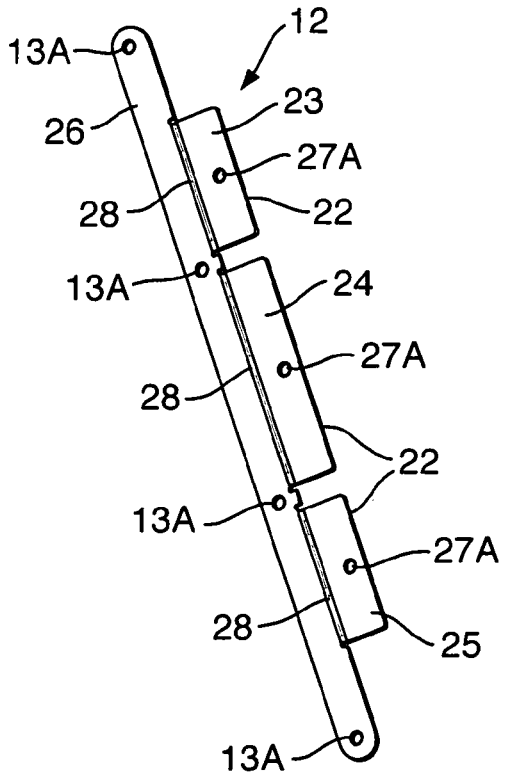
FIG. 2 shows a hinge used in the enclosure.

Referring to the accompanying drawings, a loudspeaker enclosure 1 is shown for mounting in an aperture 4 in a cavity wall 3 with a part of the enclosure being located within the wall cavity 5 adjacent the aperture. The enclosure comprises a main enclosure unit 6 for mounting in the aperture 4 and housing loudspeaker drive units 8 and an acoustic port 9, and a supplementary enclosure unit 10 for location within the wall cavity and being acoustically connected in use to the main unit 6 to increase the effective internal volume of the enclosure beyond that of the main unit. Respective oblong boxes arranged lengthwise in use with respect to each other constitute the main and supplementary units 6, 10. The supplementary unit 10 is connected to the main unit 6 by an articulated connection 12 enabling the main unit 6 to be angled relative to the supplementary unit 10 while the supplementary unit is being inserted through the aperture 4 and into the wall cavity 5, and enabling the main unit to be aligned with and acoustically coupled to the supplementary unit when the main unit is positioned in the wall aperture.

Securing means 14 are provided to fix the supplementary unit 10 in position relative to the main unit 6 when the two units are installed and aligned. The securing means 14 comprises screw-threaded securing means specifically two threaded studs 16 projecting from the supplementary unit 10, and associated wing nuts 18 to secure the ends of the studs within the main unit 6.

The articulated connection 12 comprises a so-called "living" hinge 20 of flexible polymeric material comprising a first hinge wing 22 attached, in use, to the main unit 6, a second hinge wing 26 attached, in use, to the supplementary unit 10, and a web of material 28 connecting the first and second hinge wings 22,26. The first hinge wing 22 is in the form of three tabs 23, 24 and 25.

As shown in FIG. 1, the supplementary unit 10 is of box-like form with a cover plate 11 retained by screws 13. The hinge wing 26 is secured to the supplementary unit 10 by means of four endmost ones of the screws 13 and corresponding apertures 13A in the hinge wing. The supplementary unit 10 has a large rectangular aperture 42 communicating with the interior of the supplementary unit for connection to the main unit 6.

Figure 4:
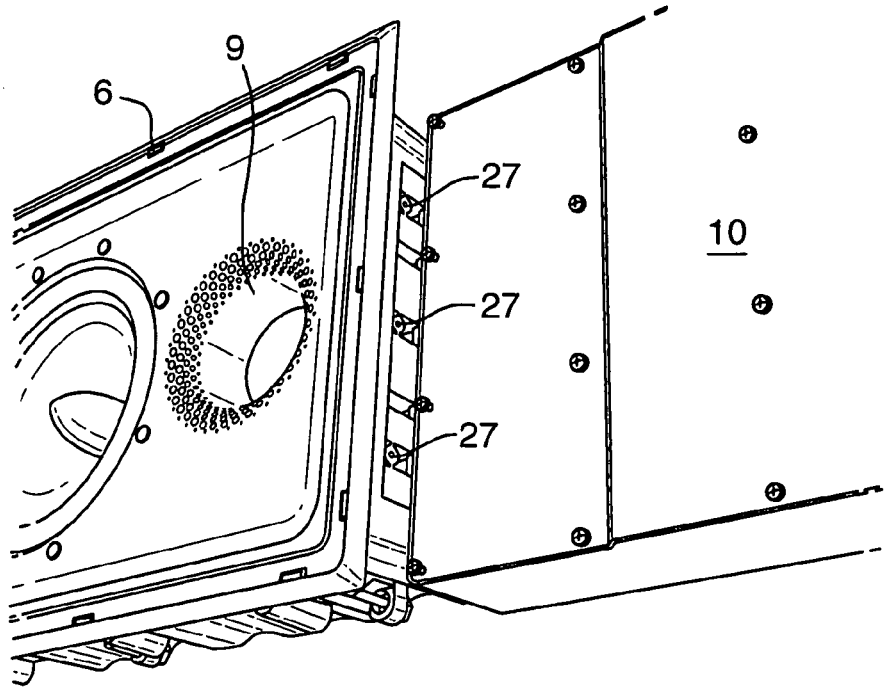
FIG. 4 shows the location at which the hinge is placed.
Figure 5:
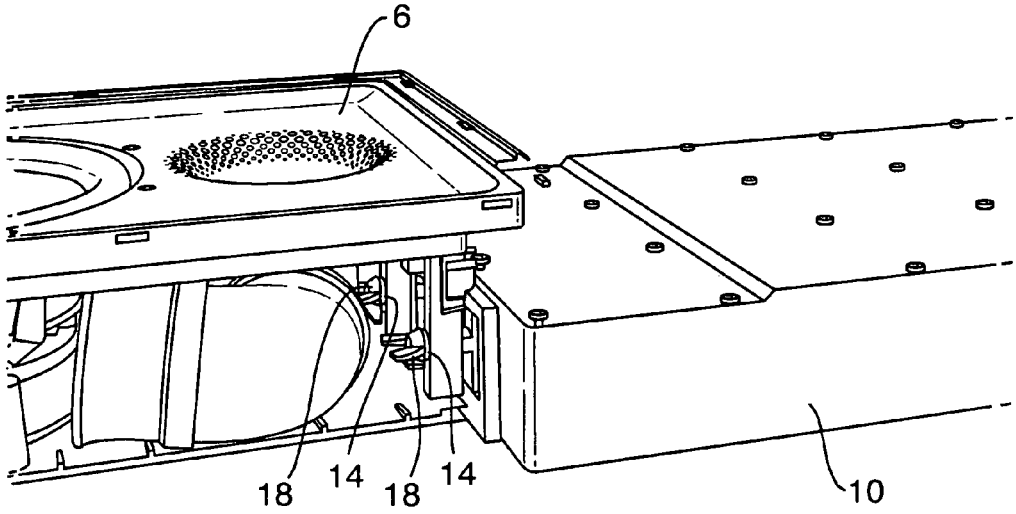
FIG. 5 shows securing means fixing the supplementary unit to the main unit, the side of the main being cut away in the drawing to reveal the interior of the main unit.

The three tabs 23, 24 and 25 of the first hinge wing 22 are secured to the main unit 6 by means of three screws 27 passing through apertures 27A in the tabs 23, 24, 25 into fixing holes 27B in the main unit 6. It should be noted that FIG. 4 shows where the hinge 20 is to go but does not actually show the hinge in position.

The supplementary unit 10 is shallower than the main unit 6 (see FIG. 6), and the articulated connection is located at the front of the supplementary unit but is spaced from the front of the main unit by a spacing 30 such as to cause the backs of the units to be in alignment in use, the terms "front" and "back" referring to the installed orientation of the units.

Figure 6:
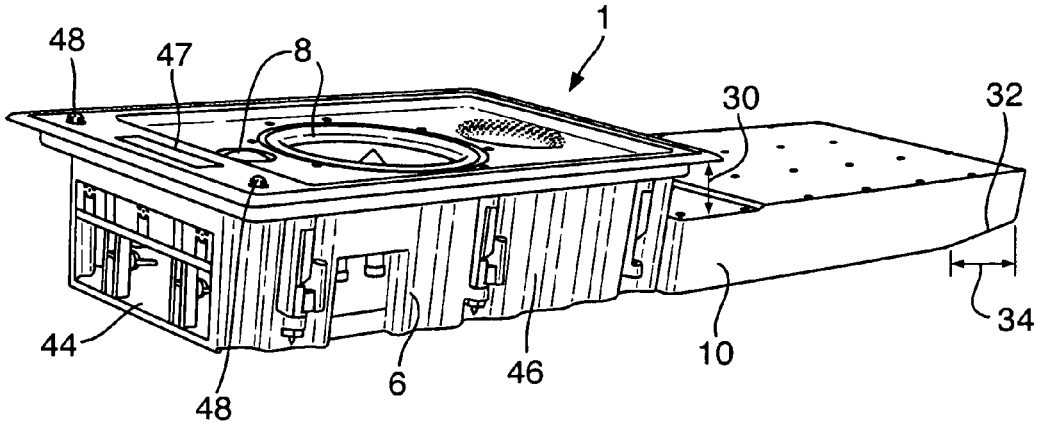
FIG. 6 is a perspective view of the main and supplementary units showing an alternative communicating aperture provided in the main unit.
Figure 7:
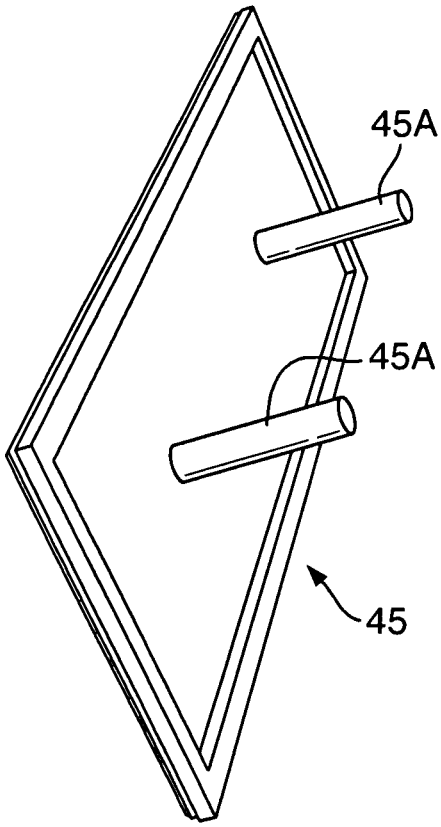
FIG. 7 is a perspective view of a blanking plate for closing the alternative aperture.

As shown in the drawings, the supplementary unit 10 has a depth substantially half that of the main unit 6 and the back, in the in use orientation, of the supplementary unit has a bevel 32 running from the end of the supplementary unit remote from the main unit for part only of the length of the supplementary unit, the partial length for which the bevel runs being marked 34 in FIG. 6.

Preferably, the bevel runs between one quarter and two thirds the lengths of the supplementary unit 10.

An acoustic sealing gasket 36 surrounding the aperture 42 is provided between the adjacent ends of the main and supplementary units 6, 10.

An aperture for acoustic communication with the other unit is provided at one longitudinal end of the supplementary unit (this is the aperture 42 already mentioned) and at each longitudinal end of the main unit, namely apertures 43 and 44 and a blanking plate 45 is provided for closing a selected one of the apertures 43, 44 of the main unit 6.

The main unit 6 comprises a crate-like body portion 46 of moulded plastics material, and a baffle plate 47 mounting the loudspeaker drive units 8 and being releasably mounted on the mouth of the crate-like body portion.

Push and turn quick-release fastenings 48, for example, the type known as Dzus, are provided to secure the baffle plate 47 to the crate-like body portion 46.

To install the enclosure 1, the main unit 6 is opened by removal of the baffle plate 47 and an articulated connection between the supplementary unit 10 to a chosen end of the main unit 6 is made using the hinge 20 and corresponding screws. The unwanted aperture 44 is closed off using the blanking plate 45 which has two threaded studs 45A for securing it in position.

Figure 3:
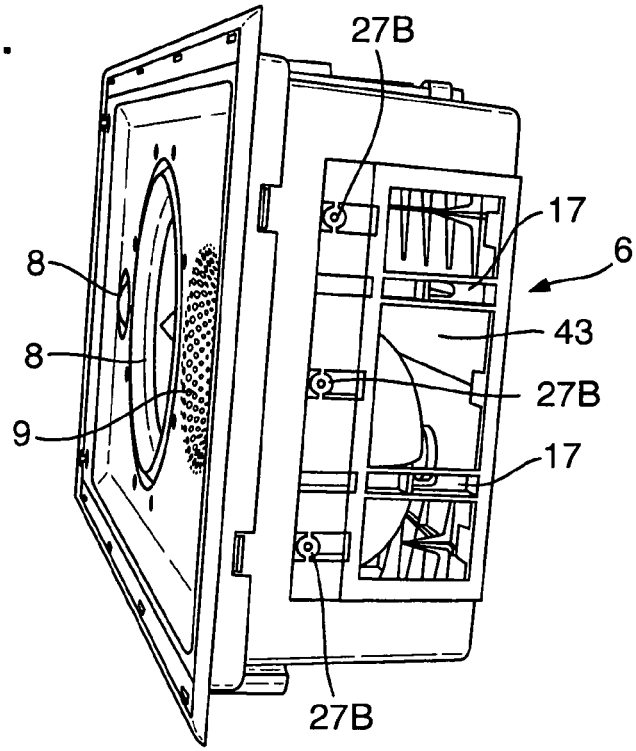
FIG. 3 is a perspective view of a main unit of the enclosure.
Figure 8:
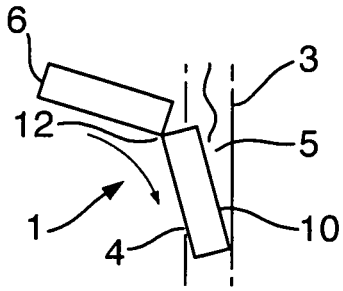
FIG. 8 is a diagrammatic side view showing the installation of the enclosure in a cavity wall.

The main unit 6 is now angled away from the supplementary unit 10 as shown in FIG. 8 and the supplementary unit is passed through the aperture 4 into the wall cavity 5, the bevel 32 facilitating entry. The supplementary unit 10 is passed so far into the cavity 5 as to allow the main unit 6 to be swung into the aperture 4 and into longitudinal alignment with the supplementary unit (as in FIG. 6). The main unit 6 is secured to the wall 3 by suitable fixing screws (not shown) and the supplementary unit 10 is rigidly connected to the main unit by applying the wing nuts 18 to the ends of the threaded studs 16 and tightening up the wing nuts. The threaded studs 16 of the supplementary unit 6 pass through struts 17 spanning the aperture 43 as seen in FIG. 3. The installation is completed by putting the baffle plate 47 back in place using the fastenings 48.

It is not essential that the articulated connection should be in the form of a living hinge, a hinge of the ordinary form with a hinge pin could be used or an arrangement using tensioned wires passing through a multiplicity of plates.

The supplementary unit 10 can be retro-fitted by means of the articulated connection 12 to an existing main unit 6.

A straight line bevel has been shown but alternatively a bevel consisting of many steps can be used, or a single step or just a few steps or a curved section.

Figure 9:
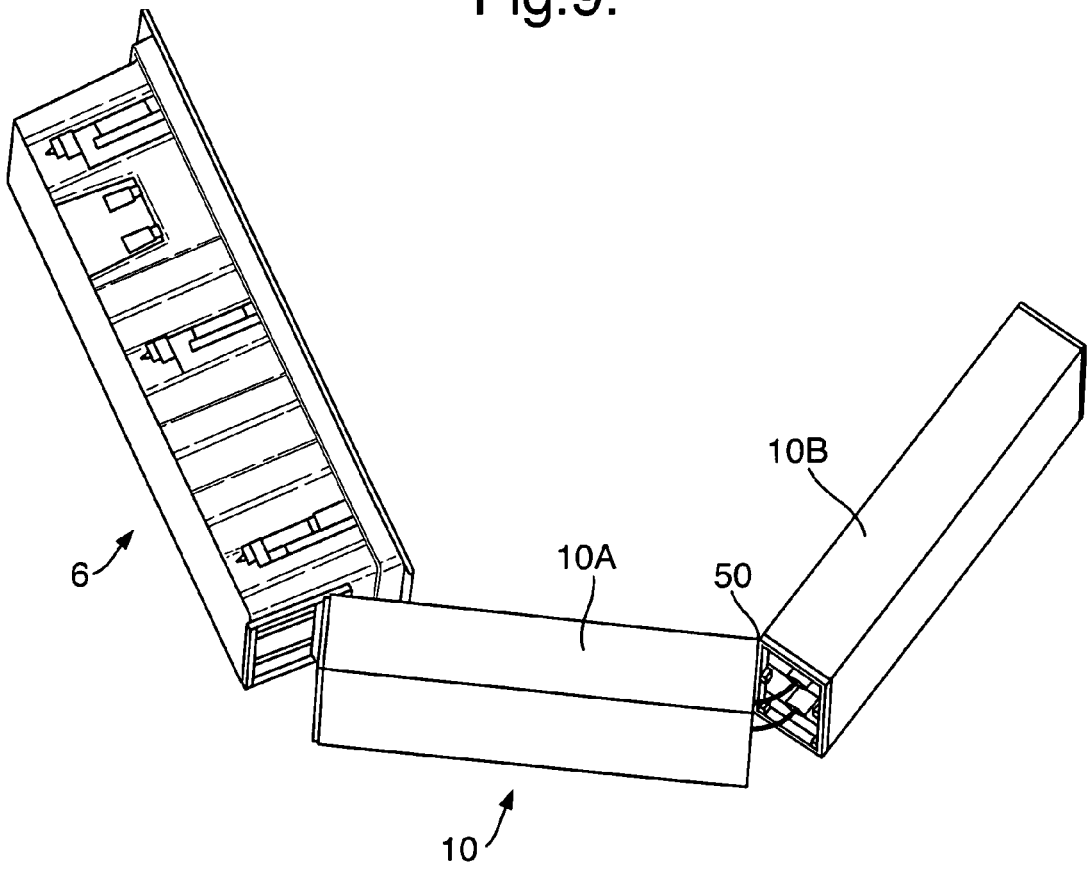
FIG. 9 is a side view in perspective of an enclosure in which the supplementary unit is divided into two parts.

FIG. 9 shows an embodiment of the invention in which the supplementary unit 10 is sub-divided into two sub-parts 10A and 10B. An articulated connection 50 (not shown in detail) is provided between the sub-parts 10A and 10B. The articulated connection 50 enables the sub-parts 10A, 10B to be angled relative to each other while the supplementary unit 10 is being inserted through the aperture and into the wall cavity, and enables the sub-parts to be aligned with and acoustically coupled to each other when the supplementary unit is positioned in the wall cavity.

Although the supplementary unit is shown sub-divided into just two sub-parts, it is possible to divide the unit into three or more sub-parts with a respective articulated connection between the adjacent sub-parts.

LIST OF REFERENCE NUMERALS

1—loudspeaker enclosure
2—cavity wall
4—cavity wall aperture
5—wall cavity
6—main enclosure unit
8—loudspeaker drive units
9—acoustic port
10—supplementary enclosure unit
10A, 10B—supplementary enclosure sub-parts
11—cover plate
12—articulated connection
13—cover plate screws
13A—apertures
14—securing means
16—threaded studs
17—struts
18—wing nuts
20—hinge
22—first hinge wing
23, 24, 25—tabs of the first hinge wing
26—second hinge wing
27—screws
27A—apertures
27B—fixing holes
28—web of material
30—spacing
32—bevel
34—partial length
36—acoustic sealing gasket
42, 43, 44—apertures for acoustic communication
45—blanking plate
45A—blanking plate threaded studs
46—crate-like body portion
47—baffle plate
48—push and turn quick-release fastenings
50—articulated connection of sub-units

The invention claimed is:

1. A loudspeaker enclosure for mounting in an aperture in a cavity wall having a wall cavity, with a part of the enclosure being located within the wall cavity adjacent the aperture, wherein the enclosure has an effective internal volume, and the enclosure comprises:

a main enclosure unit for mounting in said aperture and adapted to house one or more loudspeaker drive units, and a supplementary enclosure unit for location within said wall cavity and being acoustically connected in use to said main unit to increase the effective internal volume of said enclosure beyond that of said main unit, and wherein:

said supplementary unit is connected to said main unit by an articulated connection enabling said main unit to be angled relative to said supplementary unit while said supplementary unit is being inserted through said aperture and into said wall cavity, and enabling said main unit to be aligned with and acoustically coupled to said supplementary unit when said main unit is positioned in said wall aperture.

2. An enclosure as claimed in claim 1, wherein securing means are provided to fix said supplementary unit in position relative to said main unit when the two units are installed and aligned.

3. An enclosure as claimed in claim 2, wherein the securing means are selected from a group consisting of screw-threaded securing means, two or more threaded studs projecting from said supplementary unit and associated nuts to secure the ends of said studs within said main unit, and two or more threaded studs projecting from said supplementary unit and associated wing nuts to secure the ends of said studs within said main unit.

4. An enclosure as claimed in claim 1, wherein said articulated connection is selected from a group consisting of a hinge and a living hinge.

5. An enclosure as claimed in claim 4, wherein said hinge is a living hinge comprising a first hinge wing attached, in use, to the main unit, a second hinge wing attached, in use, to the supplementary unit, and a web of material connecting the first and second hinge wings.

6. An enclosure as claimed in claim 1, wherein an acoustic sealing gasket is provided between adjacent ends of said main and supplementary units.

7. An enclosure as claimed in claim 1, wherein said supplementary enclosure unit is sub-divided into a plurality of sub-parts, an articulated connection being provided between adjacent sub-parts, and the articulated connection of said sub-parts enabling said sub-parts to be angled relative to each other while said supplementary unit is being inserted through said aperture and into said wall cavity, and enabling said sub-parts to be aligned with and acoustically coupled to each other when said supplementary unit is positioned in the wall cavity.

8. A loudspeaker enclosure for mounting in an aperture in a cavity wall having a wall cavity, with a part of the enclosure being located within the wall cavity adjacent the aperture, wherein the enclosure has an effective internal volume, and the enclosure comprises:

a main enclosure unit for mounting in said aperture and housing one or more loudspeaker drive units, and a supplementary enclosure unit for location within the wall cavity and being acoustically connected in use to the main unit to increase the effective internal volume of the enclosure beyond that of the main unit, and wherein:

a hinge connection connecting the supplementary unit to the main unit and operative to enable the main unit to be angled relative to the supplementary unit while the supplementary unit is being inserted through said aperture and into said wall cavity, and operative to enable said main unit to be aligned with and acoustically coupled to said supplementary unit when said main unit is positioned in said wall aperture, and wherein said supplementary unit is shallower than said main unit, and said articulated connection is located at the front of said supplementary unit but is spaced from the front of said main unit by a spacing such as to cause the backs of the units to be in alignment in use, the terms "front" and "back" referring to the installed orientation of the units.

9. An enclosure as claimed in claim 8, wherein said supplementary unit has a depth substantially half that of said main unit.

10. An enclosure as claimed in claim 8, wherein said main unit comprises a crate-like body portion of moulded plastics material, and a baffle plate mounting said one or more loudspeaker drive units and being releasably mounted on a mouth of said crate-like body portion.

11. An enclosure as claimed in claim 10, wherein push and turn quick-release fastenings are provided to secure said baffle plate to said crate-like body portion.

12. An enclosure as claimed in claim 8, wherein respective oblong boxes arranged lengthwise in use with respect to each other constitute said main and supplementary units.

13. An enclosure as claimed in claim 8, wherein the back, in the in use orientation, of said supplementary unit has a bevel running from the end of said supplementary unit remote from said main unit for part only of said length of the supplementary unit.

14. A loudspeaker enclosure for mounting in an aperture in a cavity wall having a wall cavity, with a part of the enclosure being located within the wall cavity adjacent said aperture, wherein the enclosure has an effective internal volume, and the enclosure comprises:

a main enclosure unit for mounting in said aperture and adapted to house one or more loudspeaker drive units, a supplementary enclosure unit for location within said wall cavity and adapted to be acoustically connected to said main unit to increase the effective internal volume of said enclosure beyond that of said main unit, and wherein:

an articulated connection connecting said supplementary unit to said main unit and operative to enable said main unit to be angled relative to said supplementary unit while the supplementary unit is being inserted through the aperture and into the wall cavity, and operative to enable said main unit to be aligned with and acoustically coupled to said supplementary unit when said main unit is positioned in said wall aperture, and wherein one longitudinal end of said supplementary unit and each longitudinal end of said main unit all include respective apertures for acoustic communication with the other unit, and a blanking plate is provided for closing a selected one of said respective apertures of said main unit.

15. An enclosure as claimed in claim 14, wherein securing means are provided to fix said supplementary unit in position relative to said main unit when the two units are installed and aligned.

16. An enclosure as claimed in claim 15, wherein said securing means comprises screw-threaded securing means.

17. An enclosure as claimed in claim 14, wherein an acoustic sealing gasket is provided between adjacent ends of said main and supplementary units.

18. An enclosure as claimed in claim 14, wherein said supplementary unit is shallower than said main unit, and said articulated connection is located at the front of said supplementary unit but is spaced from the front of said main unit by a spacing such as to cause the backs of the units to be in alignment in use, the terms "front" and "back" referring to the installed orientation of the units.

19. An enclosure as claimed in claim 18, wherein said supplementary unit has a depth substantially half that of said main unit.

20. An enclosure as claimed in claim 14, wherein respective oblong boxes arranged lengthwise in use with respect to each other constitute said main and supplementary units.

* * * * *